US005517738A

United States Patent [19]

Wildi-Weber

[11] Patent Number: 5,517,738

[45] Date of Patent: May 21, 1996

[54] THREAD TENSIONER

[75] Inventor: Edwin Wildi-Weber, Niederuzwil, Switzerland

[73] Assignee: Benninger AG, Uzwil, Switzerland

[21] Appl. No.: 290,903

[22] PCT Filed: Dec. 17, 1993

[86] PCT No.: PCT/CH93/00287

§ 371 Date: Dec. 12, 1994

§ 102(e) Date: Dec. 12, 1994

[87] PCT Pub. No.: WO94/15006

PCT Pub. Date: Jul. 7, 1994

[30] Foreign Application Priority Data

Dec. 23, 1992 [CH] Switzerland ..... 3954/92

[51] Int. Cl.[6] ..... B65H 59/00

[52] U.S. Cl. ..... 28/194; 242/149

[58] Field of Search ..... 28/194; 242/147 R, 242/147 A, 147 M, 149, 150 R, 150 M, 151, 152.1, 153, 156, 156.1, 156.2; 66/146, 145 R

[56] References Cited

U.S. PATENT DOCUMENTS 2,646,941 7/1953 Borges .

FOREIGN PATENT DOCUMENTS 0531752 3/1993 European Pat. Off. .
1227197 8/1960 France .
3103555 10/1982 Germany .
621156 1/1981 Switzerland .

*Primary Examiner*—C. D. Crowder
*Assistant Examiner*—Larry D. Worrell, Jr.
*Attorney, Agent, or Firm*—Browdy and Neimark

[57] ABSTRACT

A thread tightener has a hollow body (49) in which is arranged a thread channel (4), as well as a tightening body (10) which may be pressed against the outlet part (49) of the thread channel (4). The hollow body (40) contains a first hollow section (41) and a second hollow section (42) which is rotatively mounted on the first hollow section (41). The thread tightener further has a device (9) for controlling the force with which the tightening body (10) is pressed against the outlet surface (47) of the hollow body (40). This control device (9) has a two-armed lever (11). One of the urns (12) of said lever carries the tightening body (10). The other level arm (13) is coupled by a spring (19) to a slide (30) for adjusting the compression force of the tightening body (10). This slide (30) is coupled by a gear to the rotary hollow insert (42). This thread tightener allows the braking force to be very finely adjusted and may have very small dimensions.

14 Claims, 3 Drawing Sheets

THREAD TENSIONER

BACKGROUND OF THE INVENTION

1. Technical Field of the Invention

The present invention relates to a thread tensioner in which a deflection of the thread takes place.

To produce a woven or knitted fabric, longitudinal threads (warp) and weft threads are required. The warp is produced on a winding apparatus which comprises a bobbin creel and a winding machine. Each warp thread is drawn off from a package, specifically "overhead". During this overhead draw-off, the threads are virtually without tension and have to be tensioned by thread tensioners, so that they can be wound in an orderly manner on the warp beam or the like.

2. Prior Art

Several thread tensioners are already known. However, these have disadvantages. The construction of the previously known thread tensioners is, as a rule, relatively complicated, because, in addition to braking means, they also have deflecting means. Such thread tensioners do not generate a constant tension in the thread, but this tension can change in an uncontrolled manner according to the circumstances prevailing in the thread tensioner. The upper limit of the tension attainable by means of the known thread tensioners is relatively low in terms of the threads handled nowadays. Thread tensioners of known construction cannot be miniaturized, this being necessary for the handling of very thin threads.

The object of the present invention is to specify a thread tensioner which does not have the disadvantages mentioned and which, moreover, also offers advantages.

Embodiments of the present invention are explained in more detail below by means of the accompanying drawings. In these:

FIG. 1 shows the present thread tensioner in a vertical longitudinal section, FIG. 2 shows the thread tensioner according to FIG. 1 in a top view and partially in section, and FIG. 3 shows a vertical section III—III through the thread tensioner according to FIG. 2.

DETAILED DESCRIPTION OF THE PREFERRED EMBODIMENT(S) OF THE INVENTION

Figure 1:
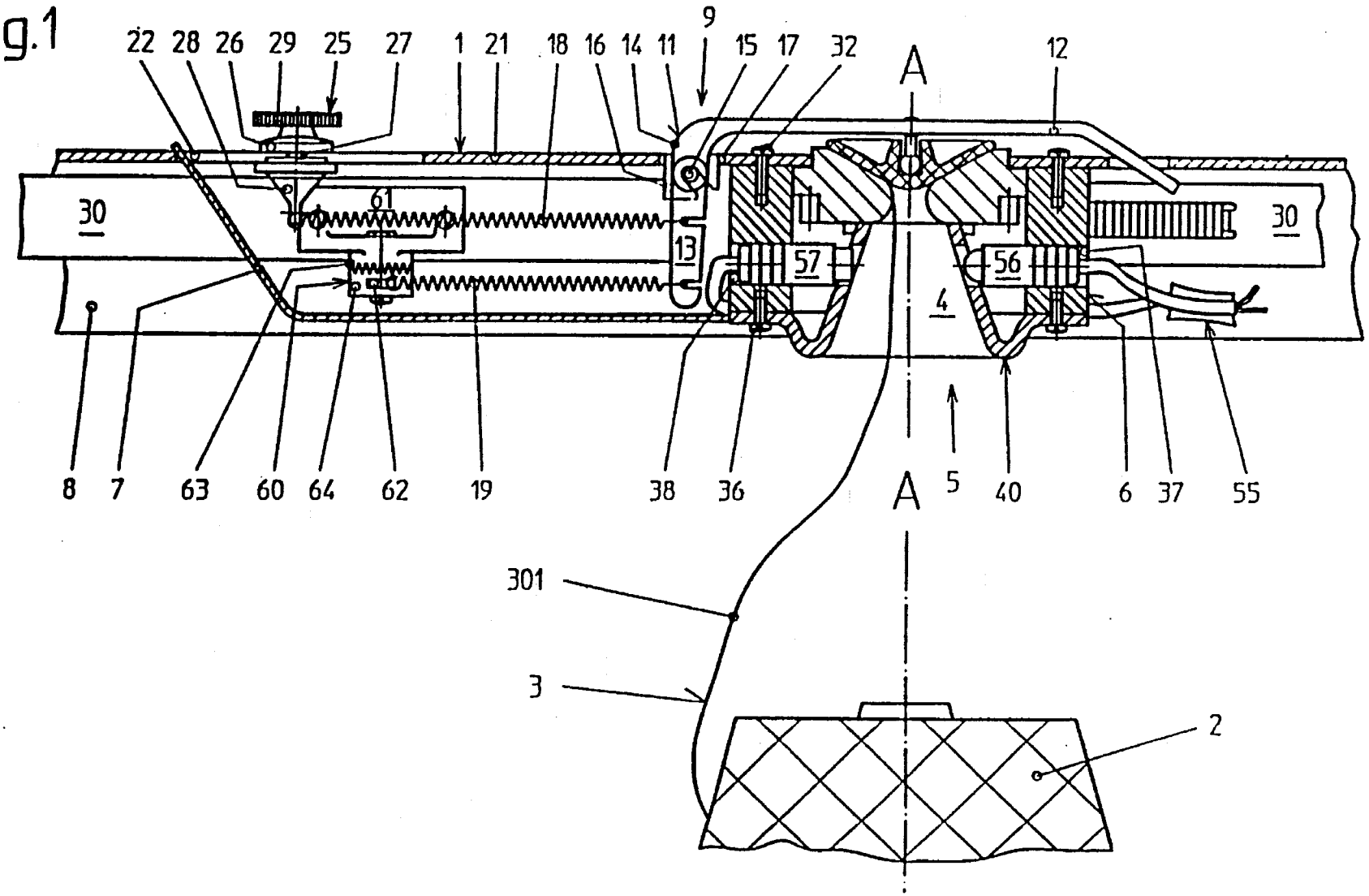
Figure 2:
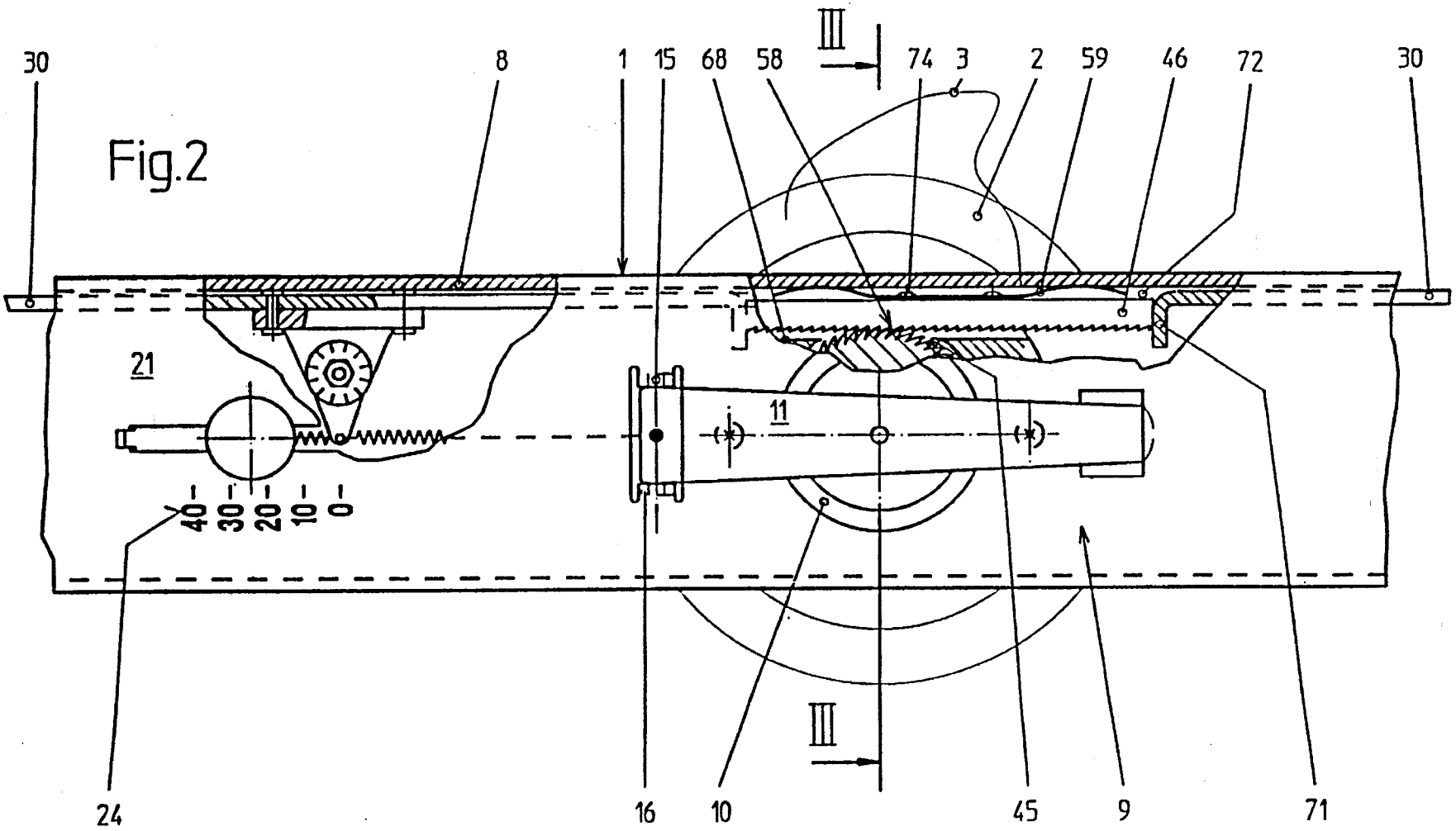

The thread tensioner (FIGS. 1 to 3) comprises a carrier 1, on which the individual components of the thread tensioner are mounted. FIGS. 1 and 2 also partially show a package 2, from which a thread 3 is drawn off "overhead". The carrier 1 shown is designed as a longitudinal piece and has a U-shaped profile. In the case shown, this profile piece 1 is oriented in such a way that its bottom 21 is located on the side of the carrier 1 facing away from the package 2, and that the legs 8 of the U-profile hang down from the bottom 21 and are directed towards the package 2. However, this profile piece 1 can also be oriented in reverse, namely in such a way that the bottom 21 of the carrier 1 faces the package 2. A plurality of thread tensioners are normally mounted on such a carrier 1. In the accompanying drawings, only one of these thread tensioners is shown. A plurality of carriers 1 form a creel, in which the threads 3 drawn off from packages 2 and to be attached to a warp beam or the like (not shown) are handled. These carriers can be arranged both horizontally and vertically.

The thread tensioner comprises, furthermore, a tension device 5 which is assigned at one end to an orifice 23 (FIG. 3) in the bottom 21 of the carrier 1. That portion of the thread 3 which is fed to the tension device 5 is designated by 301. That thread portion which runs off from the tension device 5 bears the numeral 302.

During the overhead draw-off, the portion 301 of the thread 3 drawn off from the package 2 is virtually without tension. For winding onto a warp beam or the like, however, the thread portion 302 fed to the warp beam must have a specific tension. The necessary amount of thread tension is influenced by a plurality of circumstances, and the thread tensioner is to be designed so that it can take as exact an account as possible of the circumstances mentioned during the generation of the tension. The thread tension is obtained from a difference between a pulling force, with which the warp beam or the like acts on the one end of the thread portion 302 running off from the tensioner, and a braking force, with which the tension device 5 retains the other end of said thread portion 302. The angle alpha (FIG. 3) which the running-off thread portion 302 forms with the major axis A of the tension device 5 is between 70 and 90 degrees.

The drawings also show positions or shapes of that portion 301 of the thread 3 which has been drawn off from the package 2 and which is to be handled first by the tension device 5. The positions or shapes of this thread portion 301 are obtained because the thread 3 is drawn off from the circumferential region of the package 2 and because it therefore circles around the package 2 while the apparatus is in operation.

The tension device 5 already mentioned has a housing 6 which contains some of the essential components of this device 5. The housing 6 is designed as a thick-walled tubular piece which is located inside the U-shaped carrier 1 and which is assigned at one end to the inside of the bottom 21 of the carrier 1. This assignment is such that the tubular piece 6 concentrically surrounds the orifice 23 in the carrier bottom 21. On two sides located opposite one another, the tubular piece 6 is provided with flattenings 81 and 82 extending parallel to one another. The distance between these flattenings 81 and 82 is somewhat smaller than the distance between the carrier legs 8. In the region of the flattenings 81 and 82, the material block of the housing 6 is so large that it extends from one of the U-legs 8 of the carrier 1 as far as the other U-leg 8 of this profile piece 1. The orifice 20 (FIG. 3) in the housing 6 in the form of a tubular piece is virtually cylindrical. The thickness of the wall of the housing 6 is dimensioned so that threads (FIGS. 1 and 2) for at least two fastening screws 32 and 36 can be formed in the respective end face of the housing 6. A pair of such screws 32 passes through the bottom 21 of the carrier 1 and holds the housing 6 together with the carrier 1.

Arranged in the housing 6 is a hollow body 40, in which a passage channel 4 is formed for the thread 3. The axis A of the passage channel 4, which at the same time constitutes the major axis of the tension device 5, is virtually perpendicular to the bottom 21 of the carrier 1. An exit part 49 of the hollow body 40 is assigned to the bottom 21 of the carrier 1, specifically in such a way that it is inserted in the orifice 23 in the carrier bottom 21. In the shown orientation of the carrier 1, the exit part 49 of the hollow body 40 is located at the top in the passage orifice 23 in the carrier 1.

The hollow body 40 has two portions or inserts or insert pieces 41 and 42 which are arranged one behind the other in the direction of the axis A. The cavities in these inserts 41 and 42 are of rotationally symmetrical design and they form the passage channel 4. These inserts 41 and 42 are arranged one behind the other in such a way that the rotational axes of the cavities in these coincide. Moreover, these rotational axes also coincide with the already mentioned major axis A of the tension device 5. The first insert 41 defines the entry part of the passage channel 4 and the second insert 42 defines the exit part of the passage channel 4.

The first portion or insert 41 of the hollow body 40 has a thin-walled basic body which has essentially the form of the envelope of a truncated cone. This is true primarily of the inner part 53 of this insert 41. The insert 41 can be designed as a molding, for example made from sheet steel or plastic. The insert 41 is arranged in the housing 6 in such a way that it opens away from the bottom wall 21 of the carrier 1 or that it opens towards the package 2 or that base 51 of the cone 53 which has the larger diameter is located nearer the package 2. A flange 31 adjoins the outside of this mouth 51 of the molding 53. This flange 31 extends parallel to the mouth 51, and it rests on the end face of the housing 6 facing away from the bottom wall 21 of the carrier 1. The flange 31 is fastened to the housing 6 by means of screws 36 (FIG. 1).

The first insert 41 of the hollow body 40 is located between the mouth or entry mouth 51 of the passage channel 4 facing the package 2 and the second insert 42. The first insert 41 thus extends from the inlet or entry orifice 51 towards the exit part 49 of the passage channel 4, specifically virtually as far as the start of the second insert 42.

The edge part or the entry mouth 51 of larger diameter of the insert 41 is rounded, so that the thread 3, when it runs over this edge part 51, remains, as far as possible, undamaged. The mouth 52 of smaller diameter of the cone 53 is a flat ring which serves as a sliding bearing for the second insert 42.

There is a device 55 (FIGS. 1 and 3) for monitoring the thread 3 in the passage channel 4 of the first insert 41. This thread monitor 55 is designed as a light barrier which comprises a light source 56 and a photoreceiver 57. Ducts 37 and 38 are formed at points of the housing 6 or of the conical piece 53 which are located opposite one another, the light source 56 being inserted in the first duct 37 and the photoreceiver 57 in the second duct 38. These electrical components 56 and 57 are connected to corresponding known electronic circuits (not shown) which signal whether the thread 3 is located or is moving in the passage channel 4 or not.

The second portion or insert 42 (FIG. 3) of the hollow body 40 is located in the exit region of the thread channel 4, and it extends between the first insert 41 and the bottom 21 of the carrier 1. The length or height of this insert 42 is smaller than half the length or depth of the passage channel 4.

The second insert 42 is designed as an annular body which has an essentially triangular envelope cross section. On the outside, this ring 42 has two main faces or walls 43 and 44 which are at right angles to one another. The first wall or side wall 43 extends parallel to the major axis A, and it is virtually cylindrical. The axis of this cylinder coincides with the rotational axis A of the hollow body 40. The diameter of this cylindrical wall 43 is dimensioned so that this insert 42 can be inserted in the likewise cylindrical bore 20 of the housing 6 in the same way as in a bearing housing and can at the same time rotate.

Figure 3:
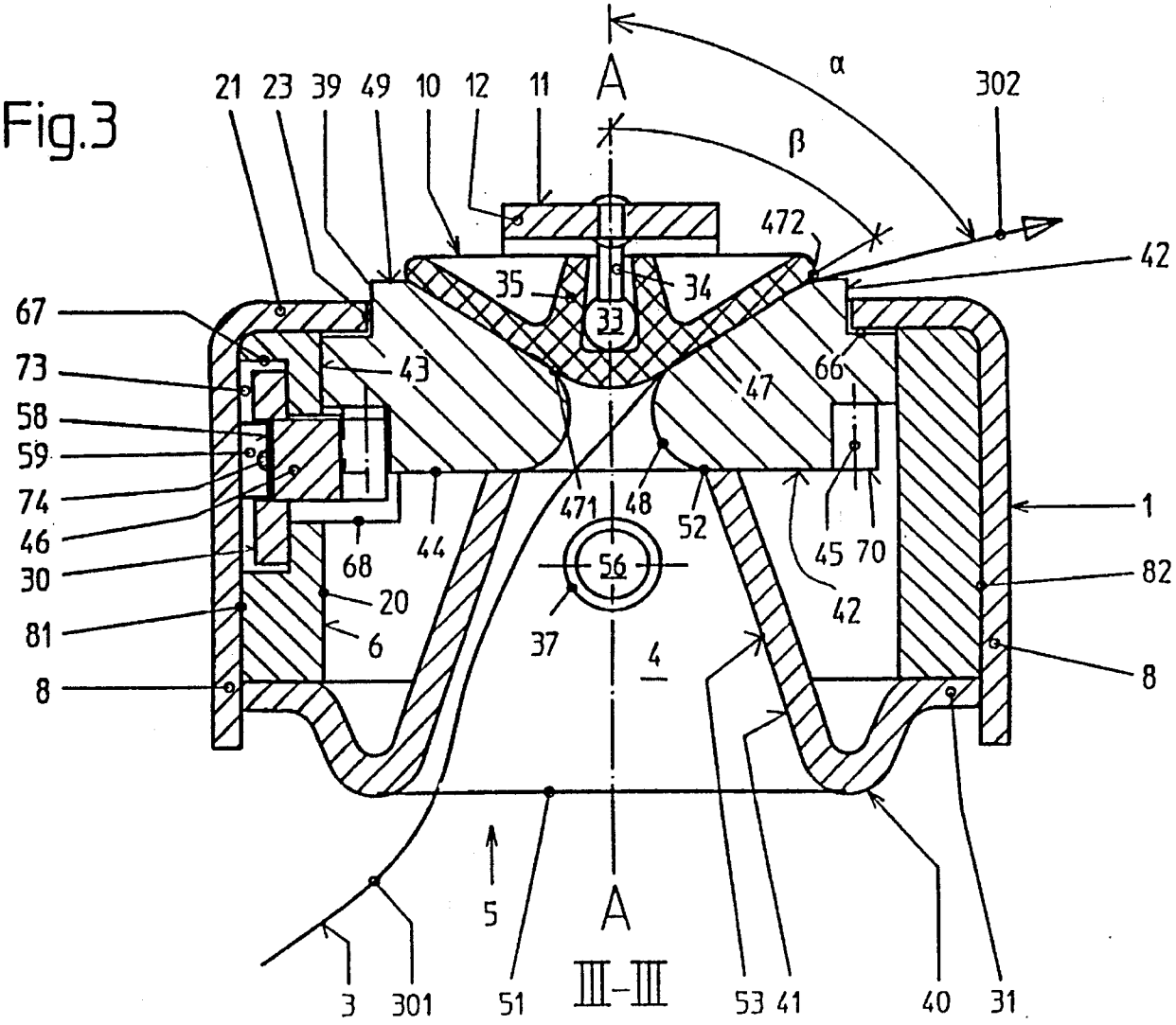

Said second wall 44 of the annular insert 42 is plane, it has the form of an annulus and it is virtually at right angles to the major axis A. The second insert 42 rests via this annular wall 44 on the annular face 52 (FIG. 3). The central orifice in the annular bottom wall 44 has a diameter which is smaller than the diameter of the smaller orifice 52 in the conical piece 53. This allows the second insert 42 to rotate on the annular face 52.

The third wall 47 of the annular insert 42, said third wall facing the exit part 49 of the thread channel 4, has essentially the form of the envelope of a truncated cone. The side line of such a cone 47 forms with the major axis A of the device 5 an angle beta which is, for example, 65 degrees. The cone wall 47 is oriented in such a way that the base 471 of smaller diameter of this cone 47 is located inside the channel 4. The base 472 of larger diameter of the cone wall 47 is located in the region of the exit part 49 of the thread channel 4. The mouth 472 of larger diameter of the cone wall 47 constitutes the exit mouth of the channel 4, and it is rounded.

At the edge, facing the thread channel 4, of the cone face or of the conical annular part face 47, that is to say in the middle region of the annular insert 42, a first inner convex and highly curved surface 48 of the second insert 42 adjoins the cone face 47. The already mentioned base 44 of the ring 42 adjoins the lower edge part of this highly convex part face 48. The greatest part of the deflection of the thread 3 from its draw-off direction from the package 2 in the region of the first thread portion 301 to its exit direction in the region of the second portion 302 of the thread 3 takes place on this convex part face 48 of the annular insert 42.

The thread 3 which is handled in the tension device 5 runs over the conical face 47 of the ring 42. This ring 42 is advantageously made from a ceramic or other abrasion-resistant material, so that this insert 42 experiences as little wear as possible from the thread 3 during the operation of the thread tensioner.

The inserts 41 and 42 are assigned to one another in such a way that the orifices of smaller diameter in these inserts 41 and 42 face one another. Consequently, those bases 44 and 52 of the inserts 41 and 42 which have the smaller diameter are located inside the passage channel 4. The bases 51 and 472 of larger diameter of the inserts 41 and 42 are located, in contrast, in the outer regions of the hollow body 40 and therefore also in the mouth regions of the tension device 5. The channel 4 therefore has essentially an X-shape in a vertical or axial longitudinal section.

That outer wall of the second insert 42 which faces the carrier bottom 21 has a recess 39 (FIG. 3). The diameter of this recess 39 or the diameter of the wall of the recess 39 extending parallel to the major axis A is somewhat smaller than the diameter of the orifice 23 in the carrier bottom 21, so that the part of the second insert 42 provided with the recess 39 still has room in this orifice 23. That annular face 66 of the recess 39 which is perpendicular to the major axis A and which is located under the edge of the orifice 23 in the carrier bottom 21 keeps the second insert 42 resting on the annular face 52 on the insert 41.

The tension device 5 comprises, furthermore, a tension body 10 (FIG. 3) which is located in the exit region 49 of the thread channel 4. The tension body 10 has essentially the form of a cone of rounded apex. This cone is advantageously a squat cone, in which the height is a fraction of the diameter of the latter. The rounded apex of the cone is located inside the passage channel 4, whilst its base is located in the region of the exit mouth 472 of the passage channel 4. The diameter of the base of the conical tension body 10 can be smaller than the diameter of the larger base 472 of the cone face 47 on the annular insert 42. The angle which the outer wall of the tension body 10 forms with the major axis A is advantageously equal to the angle beta already mentioned (FIG. 3).

The tension body 10 is assigned to the annular insert 42 in such a way that the outer wall of the tension body 10 rests on the cone face 47 on the ring 42 over as large an area as possible. The conical face 47 of the annular portion 42 thus constitutes a seat for the tension body 10. The tension body 10 covers the passage orifice 49 in the second insert 42 of the hollow body 40 and therefore also the narrowest point in the thread channel 4. Moreover, the tension body 10 also covers at least that part of the cone face 47 on the second insert 42 which adjoins the passage orifice 49.

The annular face in the region of the exit mouth 472 of the cone face 47 is likewise convex and, at the same time, is shaped or curved in such a way that the drawn-off thread portion 302 is deflected by this exit face 472 in such a way that it runs off from the second insert 42 of the hollow body 40 at an angle alpha of approximately 90 degrees in relation to the major axis A of the tension device 5 or even somewhat more.

As already stated, the greatest part of the thread deflection takes place on the highly convex part face 48 of the ring 42. The amount of this deflection depends on the slant of the cone face 47, and it can be, for example, 65 degrees in relation to the major axis A of the tension device 5 of the hollow body 40. The deflection over the rest of the angle of 90 degrees, that is to say over the remaining 25 degrees, takes place on said outer convex face 472.

In the event of a sharp deflection of the thread through approximately 65 degrees, deviations from the desired amount of tension can occur in a warp beam or a similarly fed portion 302 of the thread 3. These tension fluctuations can be prevented or eliminated with difficulty in previously known thread tensioners. In the present thread tensioner, the inner convex annular part face 48 on which the greatest part of the deflection takes place is still located upstream of that gap which is present between the cone face 47 on the ring 42 and the cone face on the tension body 10 and in which the thread 3 is nipped and braked in a controlled way. Primarily this nipping eliminates all causes of the fluctuations in the tension in the running-off portion 302 of the thread 3.

The deflection of the thread 3 on the second curved face 472 located downstream of the nip gap 47 can cause no appreciable fluctuations in the tension in the running-off portion 302 of the thread 3, because, in this region, the thread 3 is deflected only through a relatively small angle of approximately 25 degrees. When the adverse influence of the deflection of the thread 3 on this outer convex annular face 472 is to be reduced even further, then said angle beta (FIG. 3) of the conical gap 47 can be even flatter, so that the deflection on the outer convex face 472 amounts to an even smaller fraction of the total deflection.

Contact between the tension body 10 and the cone face 47 is virtually rectilinear in the direction of movement of the thread 3, because the envelope of the cone 10 and the envelope of the cone 47 have a straight line as a side line. The longer this rectilinear stage in the nip gap, that is to say the longer the side line of the cone 10 and the cone wall 47, the finer the pressing force of the braking body 10 against the seat 47 and therefore also the braking force acting on the thread 3 can be set.

In the present case, the thread 3 can be nipped in a controlled way between the braking cone 10 and the cone face 47 on the second insert 42 of the hollow body 40, by pressing the tension body 10 against the cone face 47 in a controlled way. As a result, the amount of tension in the running-off thread portion 302 can be matched continuously to the situation occurring at any particular moment during the operation of the thread tensioner.

The thread tensioner comprises, furthermore, a device 9, by means of which said pressing force in the tension device 5 can be changed. This control device 9 comprises a two-armed lever 11 which is mounted pivotably on the carrier 1 of the thread tensioner. This lever 11 is an elbow lever, the arms 12 and 13 of the latter being at right angles to one another. In the elbow region 14 of the lever 11, an axle 15 passes through this lever 11, specifically virtually perpendicularly to that plane in which the legs 12 and 13 of the elbow lever 11 are located. Bearing points 16 for the end parts of the pivot axle 15 are formed on or in the carrier 1.

That lever arm 12 which is located above the exit mouth 49 of the passage channel 4 and which extends virtually parallel to the bottom of the carrier 1 carries the tension body 10. As mentioned, the tension body 10 has virtually the form of a cone, and it is oriented in such a way that the apex of the cone 10 is directed downwards and is located in the channel 4. A connection piece 35 respectively adjoins the outside and inside of this cone 10 in the region of the apex of the cone 10, the direction of the longitudinal axis of this connection piece 35 virtually coinciding with the direction of the major axis A of the hollow body 40. A short rod 34 projects from the side of the horizontal arm 12 of the elbow lever 11 facing the tension body 10, and a ball 33 is fastened to the free end of this rod 34. The connection piece 35 is designed for receiving the ball 33, in such a way that the tension body 10 is pivotable on the ball 33 and is seated with lateral play on the latter. These measures allow the tension body 10 to rest on the seat 47 of the second insert body 42 over a large area and uniformly, as is necessary.

The other arm 13 of the lever 11 passes through a clearance 17 which is formed in the bottom 21 of the carrier 1, and it is virtually perpendicular to the bottom 21 of the carrier 1. The largest part of this lever arm 13 is located inside the carrier 1. The bearing points 16 for the end parts of the lever shaft 15 are located in the region of the clearance 17 in the carrier 1. Springs 18 and 19 act on this second arm 13 of the elbow lever 11.

The first of these springs 18 is connected to a point of the lever arm 13 which is located nearer to the pivot shaft 15 than the connection point of the other spring 19. The other ends of these springs 18 and 19 are mounted in such a way that the amount of the tensile or compressive effect on the elbow lever 11 can be set. The springs 18 and 19 can be compression springs or tension springs. In the case shown, said springs 18 and 19 are tension springs. The first spring 18 allows a local setting of the pressing force. The second spring 19 allows an adjustment of the pressing force dependent on the operation of the apparatus.

The second end of the first spring 18 is connected to a setting device 25 which serves for the local setting of the pressing force of the tension body 10. A slot 22 extending in the longitudinal direction of the carrier 1 is formed in the carrier bottom 21. The edge parts of this slot 22 are provided with scales 24 which are located on the outside of the carrier bottom 21.

The setting device 25 has a traveler 26, the web or pin 27 of which passes through the slot 22. Present at the end of the pin 27 located underneath the carrier bottom 21, that is to say inside the carrier 1, is a lower part 28 of the traveler 26, to which lower part the second end of the first spring 18 is connected. At least the portion of the pin 27 located on the outside of the carrier 1 is provided with a thread. A knob 29 which can be designed as a knurled nut is screwed onto this pin portion. The end of this knob 29 facing the carrier bottom 21 is provided with a plane face. When the knob 29 is tightened, the edges of the slot 22 are clamped between the lower knob face and the lower part 28 of the traveler 26. The position of the traveler 26 and therefore also the basic value of the action of the spring 18 on the lever 11 can thereby be set and fixed. However, the basic value of the pressing force with which the tension body 10 is to rest on the conical seat 47 in the second insert 42 is thereby also settable or set.

It is known that the amount of said pressing force has to be changed during the operation of the apparatus, that is to say during the winding of the thread onto the warp beam or the like. This operational adjustment of the pressing force relates not only to a single thread tensioner, but to virtually all the thread tensioners on the same carrier 1. In order to allow such a group change in the pressing force, a slide 30 formed as a rigid material strip is located in the carrier 1. The main face of this slide 30 is virtually parallel to the legs 8 of the U-shaped carrier 1, and it is mounted in the carrier 1 so as to be longitudinally displaceable. A groove or relief 73 (FIG. 3) is formed in that region of the outside of the material block of the housing 6 which faces the adjacent U-leg 8 of the carrier 1. This groove 73 extends in the longitudinal direction of the carrier 1 and therefore as a chord in the housing 6, and it opens towards the adjacent U-leg 8.

Connected to one end of the slide 30 is a device (not shown) which changes the position of the slide 30 in dependence on the particular amount of pressing force necessary. The length of the slide 30 is selected so that it is assigned to a plurality of thread tensioners on the same carrier 1. The second end of the second spring 19 is connected to the slide 30, with the result that the pressing force can be changed continuously during the operation of the apparatus.

So that the properties of construction of the particular thread tensioner can be taken into account in the group control of the pressing force, a fine-setting device 60, which is mounted on the slide 30 in the region of the particular tension device 5, is provided. This device comprises a baseplate 61 which is connected to the slide 30. A lever 62 is mounted pivotably and fixably on the baseplate 61. The second end of the second spring 19 is fastened to the free end of this lever 62. To fix the position of the pivoting lever 62, disks 63 and 64 having toothed counterfaces can be used. One of these disks 63 is fastened on the baseplate 61. The other end of the pivoting lever 62 is connected to the other toothed disk 64. The toothed disks 63 and 64 can be held in mutual engagement by means of a screw, after the desired tension of the second spring 19 has been set.

Since the two springs 18 and 19 act on the same arm 13 of the elbow lever 11, the pressing force of the tension body 10 is equal to the sum of the actions of the individual springs 18 and 19 on the elbow lever 11. In order to protect the components of the setting devices 25 and 60 against dirt and dust, a cover 7 is provided. This is formed as a strip which is made from a rigid material and which conceals the orifice between the free edges of the legs 8 of the U-shaped carrier 1, specifically in that region where the springs 18 and 19 are located in the carrier 1. This cover is fastened to the carrier 1 in a suitable way known per se.

A toothed wheel 70 is formed on the second insert piece 42 in that edge region of the cylindrical outer wall of the insert piece 42 which adjoins the annular bottom face 44 of this insert piece 42. This edge part of the insert 42 is provided with a peripheral shoulder, in which teeth 45 are formed. The shape of the teeth 45 is asymmetric, and such teeth 45 can advantageously be saw teeth. As is known, a saw tooth has a flank rising very steeply and a flank rising only slowly. The cross section of the groove 67 already mentioned is T-shaped, the wider portion of this cross section facing the inside of the U-leg 8. The slide 30 is mounted in this wider groove portion so as to be longitudinally displaceable. The narrower portion of the T-shaped groove 67 faces the hollow body 40. In the foot region of this narrower groove portion there is an orifice 68 (FIG. 3) which faces the toothed wheel 70 on the annular insert 42.

The side of the slide 30 facing the teeth 45 on the annular insert 42 is provided with a rack 46. This rack 46 is located in the narrower groove portion, and its teeth 45 pass through the orifice 68 in the narrower groove portion. The rack 46 is somewhat longer than the circumference of the toothed wheel 70. The teeth of this rack 46 are likewise saw teeth which project through the orifice 68 in the foot region of the T-groove into the interior of the housing 6 and which are in engagement here with the teeth 45 of the toothed wheel 70 on the annular insert 42.

The slide 30 has an elongate cutout 72 (FIG. 2) which extends in the longitudinal direction of the slide 30. The cut-out material of this slide 30 is bent out as material strips 71 out of the plane of the slide 30 in the end regions of this cutout 72. These strips 71 form holders for the ends of the rack 46. The rack 46 is therefore arranged between the holders 71. In the middle of the width of these holders 71, elongate depressions or reliefs (not shown) are formed perpendicularly to the plane of the slide 30 and extend in the longitudinal direction of the holder 71, the end parts of the rack 46 being inserted in said depressions or reliefs. The length of the reliefs is larger than the height of the rack 46, so that this rack 46 can move in the reliefs towards the major axis A and away from this.

A flat spring 59 is fastened by means of screws or rivets 74 to the side of the rack 46 facing away from the major axis A. The spring 59 passes through the cutout 72 in the slide 30, and the rear side of this spring 59 is supported on the inside of the U-leg 8 facing it. This spring 59 presses the rack 46 away from the carrier leg 8 and thus holds the rack 46 resiliently in engagement with the teeth 45 on the toothed wheel 70 on the annular insert 42.

The slide 30, which actuates the control device 9, is connected to the second and rotatably mounted insert 42 via a ratchet mechanism, pawl mechanism or free-wheel mechanism 58. During each setting movement, the slide 30 imparts a limited rotation about the major axis A to the insert 42. During the operation of the thread tensioner, the slide 30 is moved to and fro between the braking body 10 and the braking seat 47 according to the change in the pressing force. In one of these directions of movement, which can be designated as a forward movement, the steep flanks of the saw teeth 45 on the rack 46 and on the toothed wheel 70 are in engagement. In this case, the annular insert 42 is rotated somewhat about the major axis A.

When the slide 30 is moved back, the gently rising flanks of the saw teeth 45 on the rack 46 and on the toothed wheel 70 slide on one another. This is possible because the compression spring 59, which is designed as a leaf spring in the case shown, relaxes during this return movement and the rack 46 can move away from the toothed wheel 70. The annular insert 42 is not driven during this return movement. The drawing back of the rack 46 ends when the initial part of the rack 46 is located opposite the annular insert 42 again.

This process is repeated during the operation of the present apparatus. In this process, the ring 42 is rotated in only one direction. The rotation of the ring 42 reduces the abrasion of the latter caused by the thread 3 moving in its longitudinal direction. This is because that point on the ring 42 over which the thread 3 slides is changed constantly on account of the rotation of the ring 42. Moreover, dust which has accumulated on the topside of the ring 42 is taken up by the thread 3 running through and is discharged from the tension device 5.

In such a tensioning system, the pressing force can be made of any amount, without the risk that the thread may escape from this system. This system has a minimum of guide elements for the thread which exert a scarcely controllable influence on the amount of thread tension in the previously known thread tensioners. The present thread tensioner can be miniaturized, and this can have an appreciably positive influence on the dimensions of the creel. Moreover, thin plastic threads can be processed especially advantageously by means of the miniature thread tensioners. In the present tensioner, dirt which normally accumulates in the thread tensioner is eliminated continuously by the thread. On account of the possibility of imparting a rotational movement to the second hollow-body insert 42 in order to bring the thread to another point of the cone 47, the wear of this insert 42 is significantly reduced.

I claim:

1. A thread tensioner, having a tension device (5) which comprises a hollow first insert (41) forming a thread inlet having an inner surface (53) shaped as a surface of a truncated cone, a hollow second insert (42) forming a thread exit and having a basic body (49) with an inner wall section (47) shaped as a surface of a truncated cone, whereby each said truncated cone shaped surface (47, 53) of each said insert (41, 42) are engaged to each other at a base (48, 52) having a first small diameter of each said insert, said thread tensioner further comprising:

a tension body (10) with a surface shaped as a surface of a cone and located in the basic body (49) of the second insert (42), the cone shaped surface of the tension body (10) engage on the truncated cone shaped surface (47) of the second insert (42) allowing the tension body (10) to be pressed against said cone shaped surface (47) of the second insert (42), said tension body and each said insert being placed coaxially to each other in a major axis A, a package (2) comprising a supply of the thread (3) to be treated being placed coaxially to the tension device (5) in the major axis A, said package (2) being spaced below a base (51) of the first insert (41) having a second large diameter providing an inlet section (301) for the thread (3) to be drawn off overhead from the package (2) and lead into the tension device (5), a deflection angle alpha between the main axis A of the package (2) and a passage of a section (302) of the thread (3), which leaves the tension device (5) and is lead to a warp beam to form a warp thereon, said angle alpha being between 70 to 90 degrees or more, a deflection of the thread (3) by said angle alpha being effected in two steps, the thread (3) being deflected in a first deflection step by an angle beta below the truncated cone shaped surface (47) of the second insert, said angle beta being greater than a deflection angle in a second deflection step on the truncated cone shaped surface (47) of the second insert and wherein a greater part of deflection of the thread (3) takes place before the thread (3) is engaged between the tension body (10) and the second insert (42) of the tension device (5).

2. A thread tensioner according to claim 1, wherein each said insert (41, 42) is designed as annular bodies, wherein a hollow space in the interior of each said insert (41, 42) is defined by a surface of a truncated cone, wherein walls (44, 54) of each said insert (41, 42) have orifices (48, 52) are flat and stand at right angles to the main axis A, wherein one of said flat walls (44) of the second insert (42) rests on a second of said flat walls (54) of the first insert (41) and wherein the second insert (42) engages the first insert (41) to form a hollow body (40) with a passage channel (4) for the thread (3), whereby an axial longitudinal section of said channel (4) has essentially an X-shape.

3. A thread tensioner according to claim 2, wherein a diameter of first orifice (48) of said orifices of said one of said flat walls (44) of the second insert (42) is smaller than a diameter of a second orifice (52) of said orifices in said second of said flat walls (54) of the first insert (41) and wherein the second insert (42) engages said one of said flat walls (44) on said second of said flat walls (54) of the first insert (41) in such way that it allows the second insert to rotate on the first insert (41).

4. A thread tensioner according to claim 2 wherein a cross section of the second insert (42) is generally triangular, said insert (42) has two outer walls (43, 44) which are at right angles to one another, a first of said walls (43) extends parallel to the major axis A and is cylindrical, a second of said walls (44) is plane and annular, a third wall of the second insert (42) comprises said truncated cone shaped section (48), an the upper edge of a curved section (48) adjoins said the truncated cone shaped wall section (47) and a lower edge of said curved wall section (48) adjoins said second of said walls (44) of said second insert.

5. A thread tensioner according to claim 1, wherein the truncated cone shaped section (47) of said third wall of the second insert (42) forms with the major axis A of the device (5) an angle beta which equals 65 degrees or more.

6. A thread tensioner according to claim 1 wherein the tension body (10) has a shape of a squat cone in which the height is a fraction of a diameter of the squat cone.

7. A thread tensioner according to claim 2 wherein a diameter of a base of the conical tension body (10) is smaller than a diameter of an outer margin (472) of the third wall of the second insert (42).

8. A thread tensioner according to claim 1 wherein the outer margin (472) of the third wall of the second insert (42) has a rounded cross section.

9. The tread tensioner as claimed in claim 2, wherein a device (9) for controlling an amount of pressure on the tension body (1) against an exit face on the hollow body (40) is provided, and wherein this control device (9) carries the tension body (10).

10. The thread tensioner as claimed in claim 9, wherein the control device (9) has a lever (11) which is mounted pivotably relative to the hollow body (40) of the tension device (5), said lever (11) being a two-armed lever, wherein a first lever arm (12) of said two-armed lever (11) carries the tension body (10), a first spring (18) and a second spring (19) are connected at one end to a second lever arm (13) of said two-armed lever, and wherein another end of either said first spring or said second spring (18 or 19) is mounted to means for setting an amount of tensile or compressive effect on the lever (11).

11. The thread tensioner as claimed in claim 10, wherein a slide (30) which is displaceable in its longitudinal direction is provided, wherein said slide (30) is arranged tangentially to the tension device (5), wherein one end of the slide (30) is connected to a device which can change the position of the slide (30) in dependence on the particular necessary amount of pressure of the body (10) on the hollow body (40), and wherein the another end of the second spring (19) is connected to this slide (30).

12. The thread tensioner as claimed in claim 10, wherein the second insert (42) of the hollow body (40) is mounted rotatably and is driveable, and wherein there is provided a ratchet mechanism (58), via which the second insert (42) is coupled to the slide (30), so that during each setting movement of the slide (30), the second insert (42) can experience a limited rotation about the major axis (A).

13. The thread tensioner as claimed in claim 12, wherein a toothed wheel (70) is present in an outer region of the second insert (42), wherein the slide (30) carries a rack (46), and wherein the rack (46) is at least intermittently in engagement with the toothed wheel (70) on the second insert (42) of the hollow body (40).

14. The thread tensioner as claimed in claim 3, wherein there is provided a thread monitor (55) which is located in the region of the first hollow portion (41) and which is advantageously designed as an optoelectronic thread monitor.

* * * * *